US008915545B2

(12) United States Patent
Ikeda

(10) Patent No.: US 8,915,545 B2
(45) Date of Patent: Dec. 23, 2014

(54) CHAIR WITH ROTATABLE BACKREST

(71) Applicant: France Bed Co., Ltd., Tokyo (JP)

(72) Inventor: Shigeru Ikeda, Akishima (JP)

(73) Assignee: France Bed Co., Ltd., Tokyo (JP)

( * ) Notice: Subject to any disclaimer, the term of this patent is extended or adjusted under 35 U.S.C. 154(b) by 0 days.

(21) Appl. No.: 13/804,892

(22) Filed: Mar. 14, 2013

(65) Prior Publication Data

US 2013/0241249 A1 Sep. 19, 2013

(30) Foreign Application Priority Data

Mar. 19, 2012 (JP) ..... 2012-062078
Feb. 22, 2013 (JP) ..... 2013-033022

(51) Int. Cl.
*A47D 1/10* (2006.01)
*A47B 83/02* (2006.01)
*A47C 7/62* (2006.01)

(52) U.S. Cl.
CPC .. *A47B 83/02* (2013.01); *A47C 7/62* (2013.01)
USPC ..... 297/174 CS

(58) Field of Classification Search
USPC ..... 297/174 CS, 284.1, 134, 174 R
See application file for complete search history.

(56) References Cited

U.S. PATENT DOCUMENTS 1,337,103 A * 4/1920 Straith ..... 297/174 CS
3,121,592 A * 2/1964 Anderson ..... 297/284.1

FOREIGN PATENT DOCUMENTS

JP 12-003858 3/1947
JP 2006-068316 3/2006
JP 2011-110428 A 6/2011

OTHER PUBLICATIONS

Japanese Office Action for Application No. 2013-033022 mailed Mar. 4, 2014, with English translation (6 pages).

* cited by examiner

*Primary Examiner* — Milton Nelson, Jr.
(74) *Attorney, Agent, or Firm* — Harness, Dickey & Pierce, P.L.C.

(57) ABSTRACT

A chair for use in combination with a table. The chair has a seat, a back and four legs. To the back, an upper backrest and a lower backrest are secured. The lower backrest can rotate with respect to the back. While projecting forwards from the back, the lower backrest engages with the upper surface of the top plate of the table. The chair is therefore supported, with the legs suspended above the floor.

9 Claims, 12 Drawing Sheets

CHAIR WITH ROTATABLE BACKREST

CROSS-REFERENCE TO RELATED APPLICATIONS

This application is based upon and claims the benefit of priority from prior Japanese Patent Applications No. 2012-062078, filed Mar. 19, 2012; and No. 2013-033022, filed Feb. 22, 2013, the entire contents of all of which are incorporated herein by reference.

BACKGROUND OF THE INVENTION

1. Field of the Invention

Embodiments described herein relate generally to a chair designed for use in combination with a dining table.

2. Description of the Related Art

The legs of any chair used in a dining room may make obstacle to cleaning the dining room, particularly when a cleaning robot is used to sweep and brush the floor.

In view of this, a table has been made, which has a holding plate secured to the lower surface of the top plate and designed to hold the seats of chairs. (See, for example, Jpn. Pat. Appln. KOKAI Publication No. 2006-68316.) The seat of any chair may be inserted into the space between the top plate and the holding plate, thereby to hang the chair to the table.

However, this chair-holding structure, which has a relatively large holding plate located below the top plate of the table, inevitably impairs the aesthetic property of the table. Further, the chair-holding structure reduces the space in which the legs can be stored beneath the top plate of the table, ultimately making the table and chairs less easy to use.

Still further, if a chair as left and right armrests formed integral with the seat, the armrests may prevent, in some cases, the seat from entering the space between the top plate and the holding plate.

BRIEF SUMMARY OF THE INVENTION

An object of this invention is to provide a chair excelling in design, easy to use and able to be held on a table, with its legs suspended above the floor.

To achieve the object, a chair according to one embodiment, which is designed for use in combination with a table, comprises: a seat; a back; legs; and an engaging means able to project forwards from the back and configured to engage with the top plate of the table, thereby to support the chair with the legs suspended above a floor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 12 is a back view of the chair shown in

FIG. 9;

DETAILED DESCRIPTION OF THE INVENTION

Various embodiments will be described hereinafter with reference to the accompanying drawings.

First Embodiment

Figure 1:
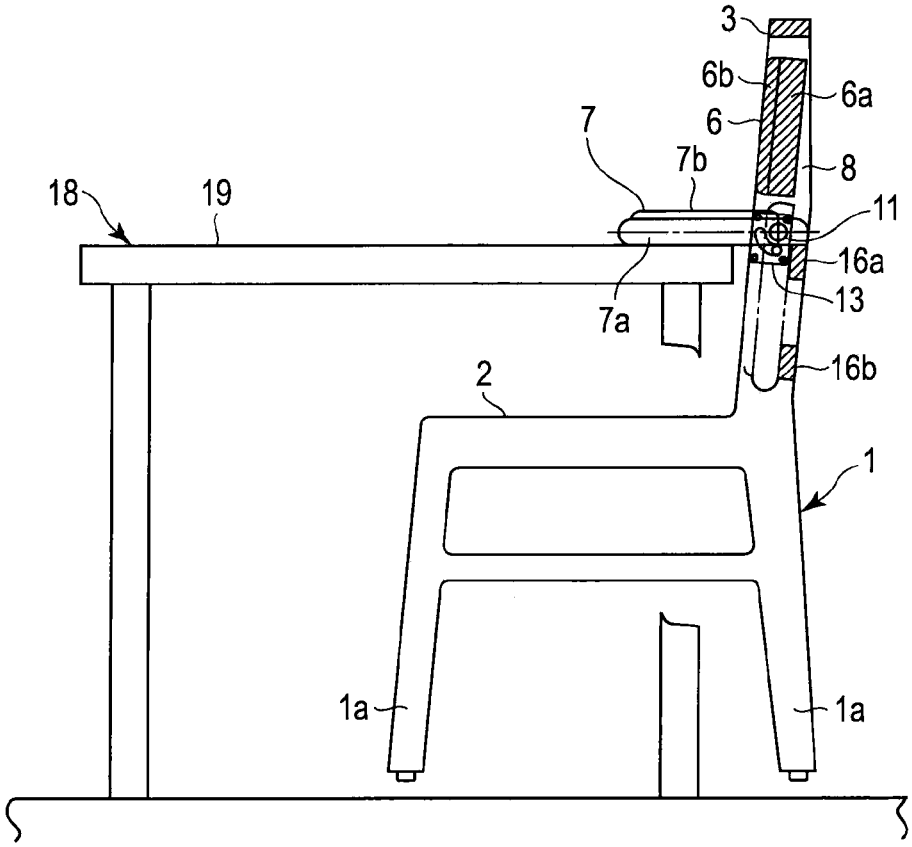
FIG. 1 is a vertical sectional view of a chair according to a first embodiment.
Figure 2:
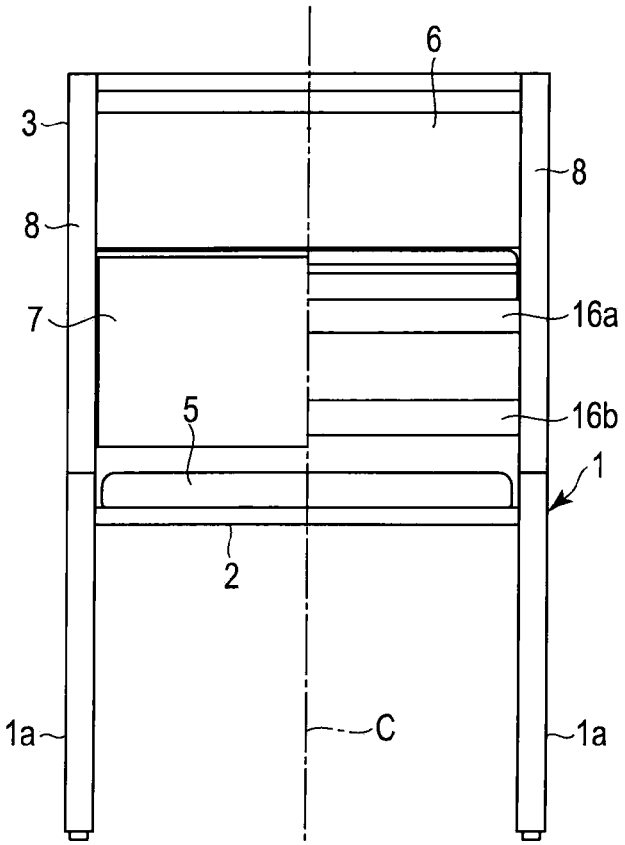
FIG. 2 is a front view of the chair shown in FIG. 1.

FIG. 1 is a vertical sectional view of a chair 1 according to a first embodiment, taken along center line C shown in FIG. 2. FIG. 1 shows the chair 1 held to the top plate 19 of a table 18. While the chair 1 remains so held, its four legs 1*a* stay above the floor. FIG. 2 is a front view of the chair 1. The right half of FIG. 2, i.e., part on the right of the center line C, shows the lower backrest 7 stored in the back 3 of the chair 1, in horizontal position (extending almost parallel to the floor). The left half of FIG. 2, i.e., part on the left of the center line C, shows the lower backrest 7, in standing position (extending almost perpendicular to the floor).

The chair 1 has a seat 2, a back 3, and four legs 1*a*. As shown in FIG. 2, a cushion 5 is secured to the upper surface of the seat 2, on which an occupant may be seated. At the back 3, an upper back rest 6 and a lower backrest 7 are provided. The lower backrest 7 functions as an engaging means for putting the chair 1 into engagement with the top plate 19 of the table 18, thereby to suspend the chair 2 from the top plate 19.

Figure 3:
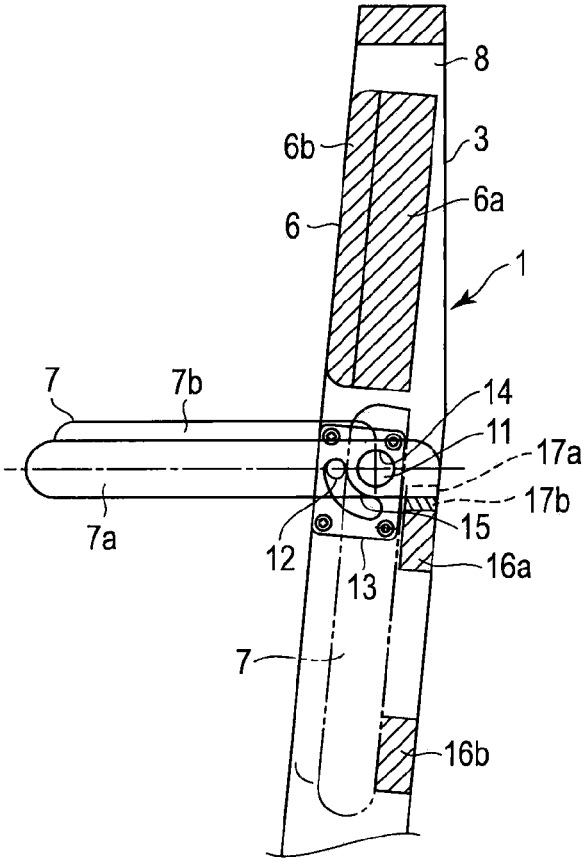
FIG. 3 is a magnified view showing the major section of the chair shown in FIG. 1.
Figure 4:
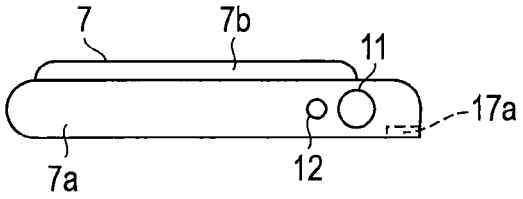
FIG. 4 is a side view illustrating the one side of the lower backrest of the chair shown in FIG. 3, as viewed in the widthwise direction of the lower backrest.

FIG. 3 is a magnified view showing the major section of the chair 1 shown in FIG. 1, i.e., the back 3 of the chair 1. FIG. 4 is a side view illustrating the one side of the lower backrest 7 shown in FIG. 3, as viewed in the widthwise direction of the lower backrest 7. As FIG. 3 shows, the upper backrest 6 has a base plate 6*a* and a cushion 6*b*. The cushion 6*a* is secured to the front of the base plate 6*a*. The upper backrest 6 extends between two stiles 8 (see FIG. 2), and is fastened, at both ends, to the stiles 8. The stiles 8 extend upwards from the rear legs 1*a* of the chair 1.

As shown in FIG. 4, the lower backrest 7 has a base plate 7*a* and a cushion 7*b*. The cushion 7*b* is secured to the front of the base plate 7*a* (or the upper surface thereof, in the state of FIG. 4). A support rod 11 and a pin 12 protrude from either side of the base plate 7*a* (as viewed in the widthwise direction). The support rods 11 are provided near the upper edge of the base plate 7*a* (or at right edge thereof, in FIG. 3). The pins 12 are provided near and below the support rods 11 (or near and on the left of thereof, in FIG. 3).

Two guide members 13 shaped like a rectangular plates are secured to the opposing inner sides of the two stiles 8, respectively. As magnified in FIG. 3, either guide member 13 has a support hole 14 and a guide hole 15. The support hole 14 receives the support rod 11, enabling the same to rotate in it. The guide hole 15 receives the pin 12, enabling the same to slide. The inner side of either stile 8, to which the guide member 13 is secured, may have holes of the same shapes as the support 14 and guide hole 15, respectively.

The guide holes 15 are arcing around the support holes 14. The guide holes 15 have such a length that the lower backrest 7 can be rotated around the support rod 11 by, at maximum, about 90°. Thus, if the lower backrest 7 is stored in the back 3 as a two-dot, dashed line indicates in FIG. 3, the pins 12 abut, each on one end of the guide hole 15, preventing the lower backrest 7 from moving further. If the lower backrest 7 is rotated around the support rod 11, assuming the horizontal position indicated by the solid line in FIG. 3, the pins 12 abut, each on the other end of the guide hole 15, preventing the lower backrest 7 from moving further.

Between the two stiles 8 of the back 3, two support members 16*a* and 16*b* extend, abutting on the back of the lower backrest 7 and thus supporting the lower backrest 7. More precisely, if the lower backrest 7 is rotated to the position indicated by the two-dot, dashed line in FIG. 3, or if stored into the back 3, the two support members 16*a* and 16*b* abut on the back of the lower backrest 7, supporting the lower backrest 7.

If the lower back rest 7 is rotated to the horizontal position indicated by the solid line in FIG. 3, i.e., position almost parallel to the floor, the base plate 7*a* will abut, at the back of its upper edge (or at the lower part of the right end, on the right of the support rod 11). This prevents the lower backrest 7 from further rotating upwards.

The support member 16*a*, which is positioned above the other support member 16*b*, controls the rotation of the lower backrest 7 as described above, and can hold the lower backrest 7 at one of two positions, to store lower backrest 7 in the back 3 or to make it project forward from the back 3 and assume an almost horizontal position. Hence, the support member 16*b*, which positioned below the support member 16*a*, can be dispensed with.

A magnet 17*a* (holding means) is embedded in the back of the upper edge of the base plate 7*a*. A magnet 17*b* (holding means) is embedded in the upper surface of the support member 16*a*. The magnets 17*a* and 17*b* can hold the lower backrest 7 in a rotated position, i.e., almost horizontal position. To release the lower backrest 7 from this position, the front edge of the lower backrest 7 may be pushed down, moving the magnets 17*a* and 17*a* away from each other.

That is, to hold the chair 1 on the top plate 19 of the table 18, the lower backrest 7 is pulled out, setting it in an almost horizontal position, almost parallel to the floor (as shown in FIG. 3). As a result, the magnets 17*a* and 17*b* attract each other and contact each other. The lower backrest 7 is thereby held, temporarily extending in horizontal direction. Then, the chair 1 is moved to a position, where the lower backrest 7 is set in plane contact with the upper surface of the top plate 19 of the table 18. Thereafter, the chair 1 remains held on the table 18, because of its weight, with its legs 1*a* suspended above the floor.

While the chair 1 remain so held on the table 18, either pin 12 abuts on one end of the associated guide hole 15, and the back of the upper edge of the base plate 7*a* abuts on the upper surface of the support member 16*a*. The lower backrest 7 is therefore prevented from rotating, despite the weight of the chair 1. In other words, the pins 12, guide holes 15, base plate 7*a* and support member 16*a* control the rotation of the lower backrest 7, in spite of the weight of the chair 1.

In order to remove the chair 1 from the table 18 so that it may be used in an ordinary manner, the chair 1 is lifted a little from the position shown in FIG. 1, moving the back of the base plate 7*a* of the lower backrest 7 from the upper surface of the top plate 19 of the table 18. Then, the chair 1 is lowered until its four legs 1*a* touch the floor. Next, the lower backrest 7 is pushed down, at its front edge, releasing the magnets 17*a* and 17*b* from mutual magnetic engagement. The lower backrest 7 is thereby stored in the back 3, and the chair 1 can be used in the ordinary manner.

In this embodiment, the magnets 17*a* and 17*b* embedded in, respectively, the back of the upper edge of the base plate 7*a* and the upper surface of the support member 16*a* are utilized as means for holding the lower backrest 7 in a horizontal position. Instead, only one magnet and a magnetic member may be used. Alternatively, planner fasteners that can engage with each other may be utilized in place of the magnets. Any means can be used instead, only if they can hold the lower backrest 7 in a horizontal position. Moreover, such holding means can be dispensed with. For example, the lower backrest 7 may be latched on the top plate 19 of the table 18, while being held with hands.

In this embodiment, a support rod 11 and a pin 12 are further provided at either side of the lower backrest 7, and either stile 8 of the back 3 has a guide member 13 (having support hole 14 and guide hole 15). The invention is not limited to this configuration, nevertheless. The support rod 11 and the pin 12 may protrude from the inner surface of either stile 8, and the guide member 13 may be provided on either side of the lower backrest 7. Alternatively, the support rod 11 and the guide hole 15 may be provided on, and made in, one of either lower backrest 7 and either stile 8, and the pin 12 and the support hole 14 provided on, and made in, the other of either lower backrest 7 and either stile 8. In this case, the guide member 13 need not be used.

Thus, the chair 1 according to this embodiment can be held on the table 18, with its legs 1*a* suspended above the floor, only if the lower backrest 7 is pulled out from the back 3 to a horizontal position. The chair 1 is therefore more useful than otherwise. Moreover, the table 18 need not be changed in design to hold the chair 1. Hence, the chair 1 can be used in combination with a table of whatever design, increasing the freedom of table-chair combination. Further, the lower backrest 7 can remain stored in the back 3 while the chair 1 is being used in the ordinary manner, impairing neither its aesthetic property nor its usability.

Also in this embodiment, a relatively large holding plate need not be arrange below the top plate 19 to provide a gap into which the seat of a chair may be inserted, as in the case of the conventional table described above. Therefore, the user never has his or her laps abut on the holding plate while sitting on the chair. Further, without a holding plate, the table would not have its aesthetic property impaired.

The chair 1 according to this embodiment differs from ordinary chairs, only in that the back 3 stores a structure serving to hold the chair on a table. The structure can serve to hold the chair on a table, regardless of the thickness and shape of the seat 2. By contrast, the conventional table described above cannot hold a chair in the gap between the top plate and the holding plate if the seat cushion is relatively thick, because the holding plate is secured beneath the top plate. The chair 1 according to this embodiment can be held on a table, though it has armrests formed integral with the seat. However, the conventional table cannot hold chairs having such armrests.

Moreover, since the lower backrest 7 can be pulled forwards from the back 3 and can then be used as member for holding the chair 1 on the table 18. The chair 1 can therefore be held on the top plate 19 of the table 18 only if it is lifted, without being changed in orientation, thereby improving the use efficiency of the chair 1. In addition, since the chair 1 need not be turned upside down to hold it on the table 18, even children or women not so physically strong can easily hold the chair 1 on the table 18.

Other embodiments will be described with reference to FIG. 5 to FIG. 18. The components identical to those of the first embodiment are designated by the same reference numbers in FIG. 5 to FIG. 18, and will not be described in detail.

Second Embodiment

Figure 5:
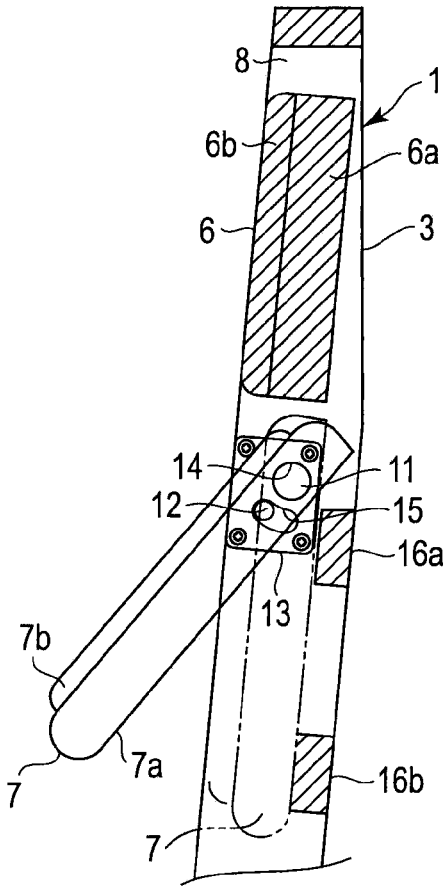
FIG. 5 is a magnified sectional view showing the major section of a chair according to a second embodiment.

FIG. 5 shows the back 3 of a chair 1 according to a second embodiment. The chair 1 according to this embodiment is essentially identical to the chair 1 according to the first embodiment, except that the guide hole 15 of either guide member 13 is shorter than its equivalent of the first embodiment.

Therefore, the lower backrest 7 of the chair 1 according to this embodiment is configured to rotate around the support rod 11 by, at maximum, an angle smaller than 90°. In this embodiment, the guide hole 15 has such a length and so positioned that the lower backrest 7 may be rotated up by, for example, 30° from the position it assumes while stored in the back 3. Hence, the lower backrest 7 is positioned slantwise as shown in FIG. 5 if fully pulled from the back 3.

That is, if the lower backrest 7 is pulled most from the back 3, its lower edge will more approach the floor than the lower edge of backrest 7 of the first embodiment. The chair 1 can therefore be held at a higher position than the chair according to the first embodiment, while its lower backrest 7 remains engaged, at the lower edge, with the top plate 19 of the table 18. Thus, the chair 1 according to this embodiment can be held, with its legs 1*a* suspended above the floor, even if the legs 1*a* are relatively long.

In the second embodiment, the backrest may not be split into halves, i.e., upper backrest and lower backrest. In this case, one support rod 11 and one pin 12 are provided on either side of the backrest, near the upper edge thereof, two guide members 13 are on the mutually opposing inner sides of the back 3, respectively. Then, the single backrest can be rotated by, for example, 0° to 30°.

Third Embodiment

Figure 6:
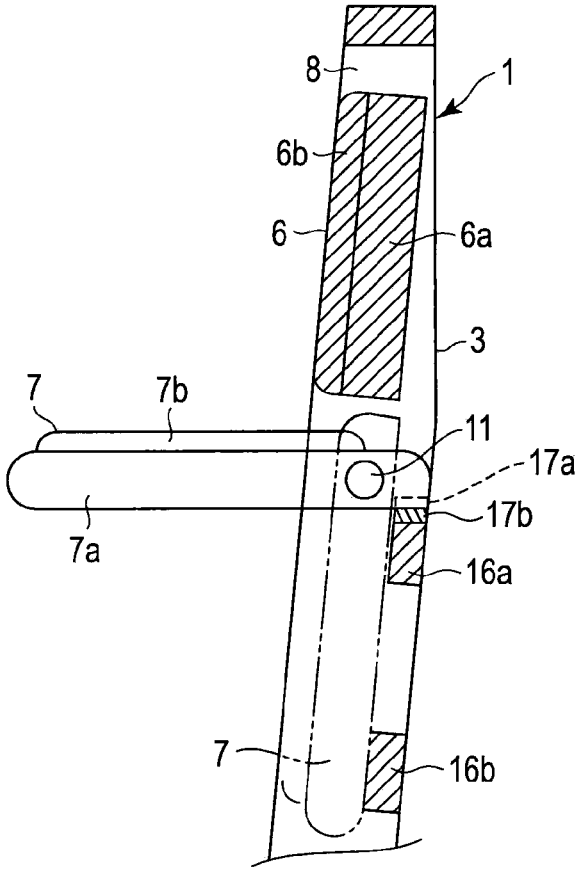
FIG. 6 is a magnified sectional view showing the major section of a chair according to a third embodiment.

FIG. 6 shows the back 3 of a chair 1 according to a third embodiment. The chair 1 according to this embodiment has no guide members 13 on the mutually opposing inner sides of the back 3. Only a support rod 11 is provided on either side of the lower backrest 7, and no pin 12 is provided on either side of the lower backrest 7. Two support holes are made, one in the inner side of one stile 8 and the other in the inner side of the other stile 8. The support holes receive the ends of the support rod 11, enabling the support rod 11 to rotate. Except for these features, the chair 1 according to this embodiment is almost identical in structure to the chair according to the first embodiment.

If the lower backrest 7 is rotated around the support rod 11 to the horizontal position indicated by the solid line in FIG. 6, the upper edge of the lower backrest 7 abuts, at the back, on the upper surface of the support member 16*a*, preventing the lower backrest 7 from moving further. Then, the magnets 17*a* and 17*b* magnetically contact each other, holding the lower backrest 7 in the position indicated by the solid line. In this state, the lower backrest 7 may be pushed down at its front edge, and may be stored in the back 3. If this is the case, the back of the lower backrest 7 abuts on both support members 16*a* and 16*b* (i.e., upper and lower support members), controlling the motion of the support members 16*a* and 16*b*.

Thus, this embodiment has the same functions as the first embodiment, and can yet be more simple in structure than the first embodiment. Composed of fewer components than the first embodiment, the second embodiment can be manufactured in fewer steps, and at a lower cost than the first embodiment.

Fourth Embodiment

Figure 7:
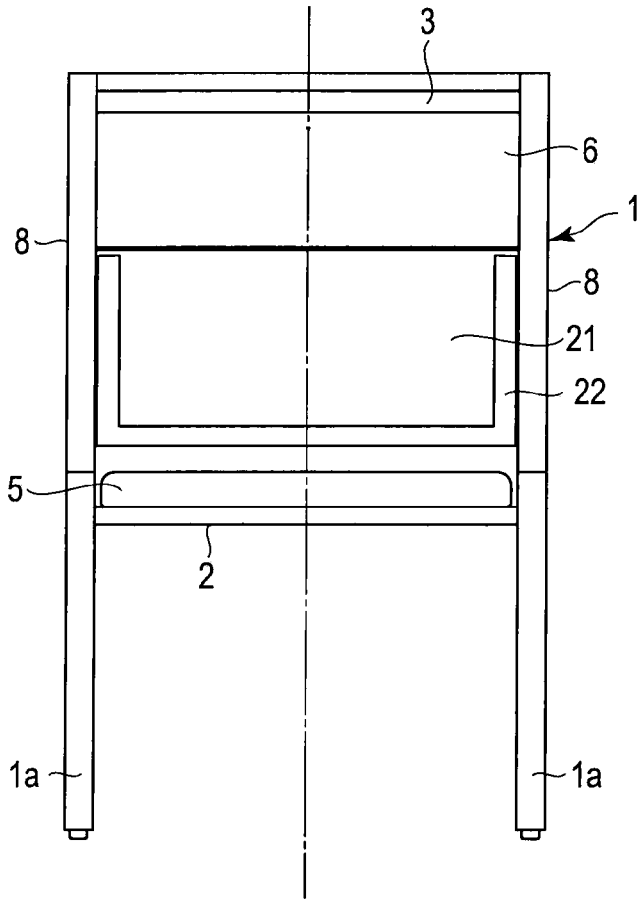
FIG. 7 is a front view of a chair according to a fourth embodiment.

FIG. 7 is a front view of a chair 1 according to a fourth embodiment. The chair 1 according to this embodiment is essentially identical in structure to the chair 1 according to the first embodiment, except that a U-shaped engaging member 22 is used in place of the lower backrest 7. U-shaped, the engaging member 22 defines a large rectangular opening 21.

A support rod 11 and a pin 12 are provided at either upper lateral edge of the engaging member 22. Either stile 8 of the chair 1 has, on its inner surface, a guide member 13 that has a support hole 14 and a guide hole 15. In this embodiment, the engaging member 22 stored in the back 3 can be rotated upwards by 90°.

Hence, the chair 1 is supplied by the table 18, with its legs 1*a* suspended above the floor, if the engaging member 22 is rotated upwards, with its lower end protruding forwards from the back 3, and is engaged with the upper surface of the top plate 19 of the table 18.

Fifth Embodiment

Figure 8:
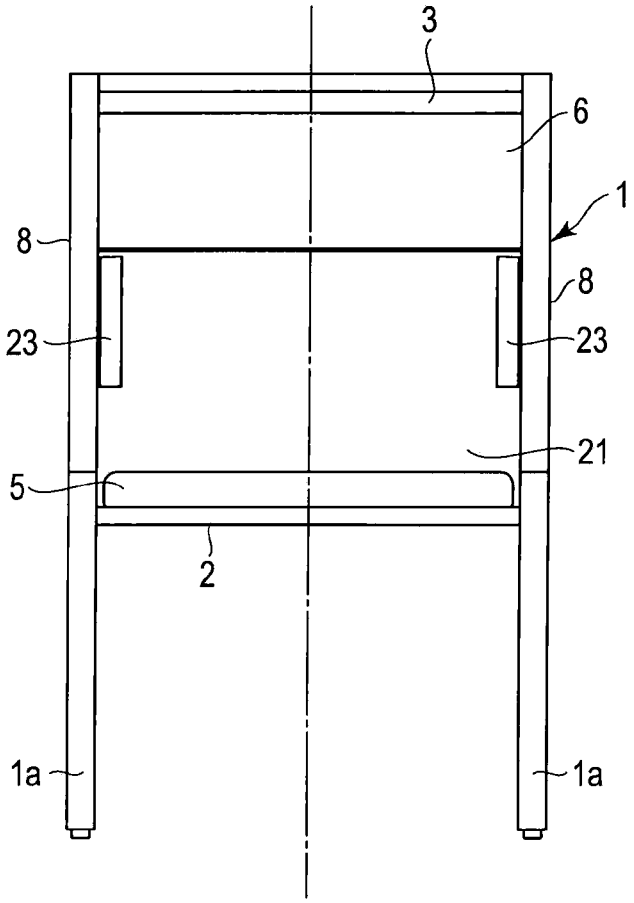
FIG. 8 is a front view of a chair according to a fifth embodiment.

FIG. 8 is a front view of a chair 1 according to a fifth embodiment. This chair 1 is essentially identical in structure to the chair 1 according to the fourth embodiment, except that two engaging member 23 shaped like a straight rod are used in place of the U-shaped engaging member 22. The engaging member 23 are provided on, respectively, the inner sides of the stiles 8 of the back 3 and can be rotated independently of each other. Either engaging member 23 can be rotated with respect to the associated stile 8, in the same way as U-shaped engaging member 22 is rotated in the fourth embodiment.

Therefore, if both engaging members 23 are rotated up, with their lower end protruding forwards from the back 3 of the chair 1, they will be engaged with the upper surface of the top plate 19 of the table 18 in this embodiment, too. Then, the chair 1 can be held to the table 18, with its legs 1*a* suspended above the floor.

Sixth Embodiment

Figure 9:
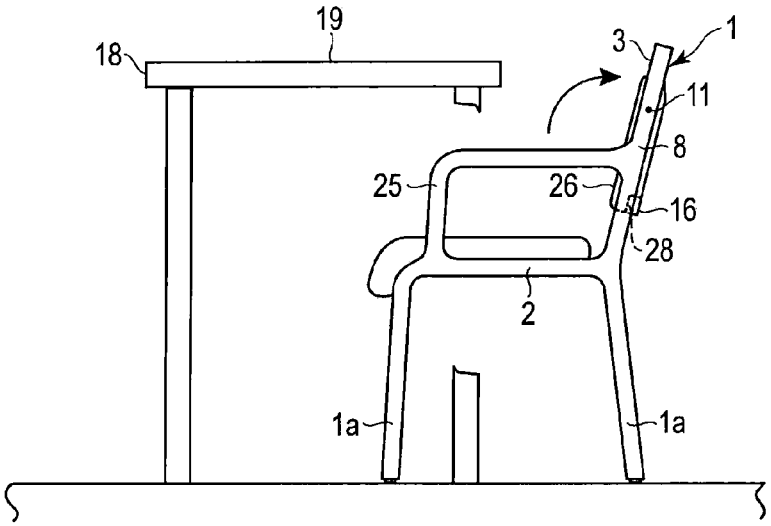
FIG. 9 is a side view of a chair according to a sixth embodiment, as viewed from one side, in the widthwise direction of the chair.
Figure 10:
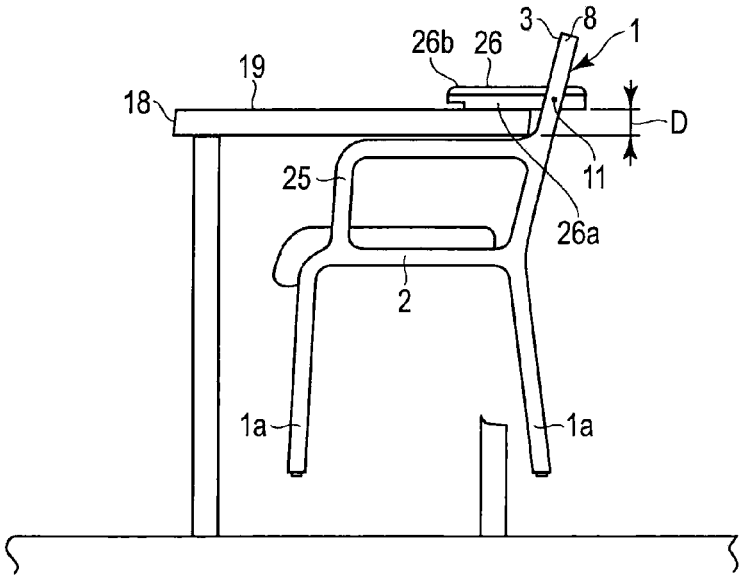
FIG. 10 is a side view of the chair shown in FIG. 9, held to the top plate of a table, with its legs suspended above the floor.
Figure 11:
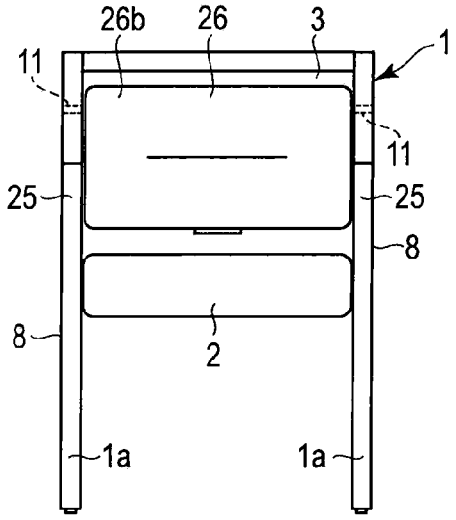
FIG. 11 is a front view of the chair shown in FIG. 9.
Figure 12:
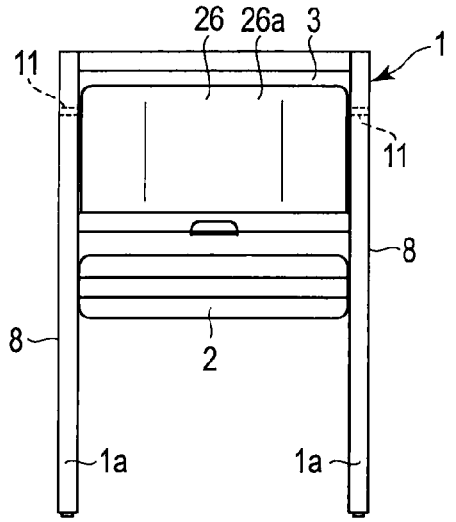
Figure 13:
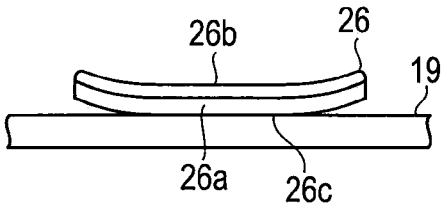
FIG. 13 is a diagram showing the backrest of the chair shown in FIG. 9, which is engaged with a table.

A chair 1 according to a sixth embodiment will be described, with reference to FIG. 9 to FIG. 13. FIG. 9 is a side view of a chair 1 according to this embodiment, as viewed from one side, in the widthwise direction of the chair 1. FIG. 10 is a side view of the chair 1 held to the top plate 19 of a table 18. FIG. 11 is a front view of the chair 1. FIG. 12 is a back view of the chair shown in FIG. 9. FIG. 13 is a diagram showing the backrest 26 of the chair 1, engaged with the top plate 19 while pulled up in the state shown in FIG. 10.

The chair 1 according to this embodiment has armrests 25 at the sides of the seat 2, respectively. The back 3 of the chair 1 has one backrest 26, which functions as engaging means. The backrest 26 can rotate around a support rod 11, from the position shown in FIG. 9 to the position shown in FIG. 10, like the lower backrest 7 of the chair 1 according to the first embodiment.

That is, a support rod 11 and a pin 12 are provided on either side of the backrest 26, near the upper edge thereof, as in the first embodiment. On the inner surface of either stile 8 of the back 3, a guide member 13 having a support hole 14 and a guide hole 15 is provided. The support hole 14 receives the support rod 11, enabling the same to rotate in it. The guide hole 15 receives the pin 12 and guides the pin 12.

If the backrest 26 is rotated to the horizontal position shown in FIG. 10, the pin 12 abuts on one end of the guide hole 15, preventing the backrest 26 from rotating further. If the backrest 26 is stored in the back 3 as shown in FIG. 9, a support member 16 engages with a step 28 made at the lower edge of the backrest 26, also preventing the backrest 26 from rotating further.

Magnets which attract each other may be provided at the step 28 and the support member 16, respectively. Alternatively, planner fasteners that can engage with each other may be provided at the step 28 and the support member 16, respectively. In either case, the backrest 26 can be prevented from rotating unnecessarily, while the backrest 26 remains stored in the back 3. The backrest 26 can thereby held in the ordinary use state.

The support rod 11 (also, support hole 14), on which the backrest 26 can rotate, is located at a position higher than the upper edge of either armrest 25. That is, the support rod 11 is located at such height that the gap D between the back (or lower surface in FIG. 10) of the back rest 26 and the upper edge of either armrest 25 may be larger than the thickness of the top plate 19 of the table 18, after the backrest 26 has been pulled up to the horizontal position shown in FIG. 10. The chair 1 can therefore be held on the top plate 19 of the table 18, though the chair 1 has armrests 25.

As shown in FIG. 13, a cushion **26*b* is provided on the front of the base plate 26*a* of the backrest 26, and both lateral edges of the base plate 26*a* are curved forwards. Therefore, the back of the base plate 26*a*, which has a horizontal flat surface 26*c*, will face down if the backrest 26 is rotated up to an almost horizontal position. At the horizontal surface 26*c*, the backrest 26 can be stably engaged with the upper surface of the top plate 19 of the table 18**.

Seventh Embodiment

Figure 14:
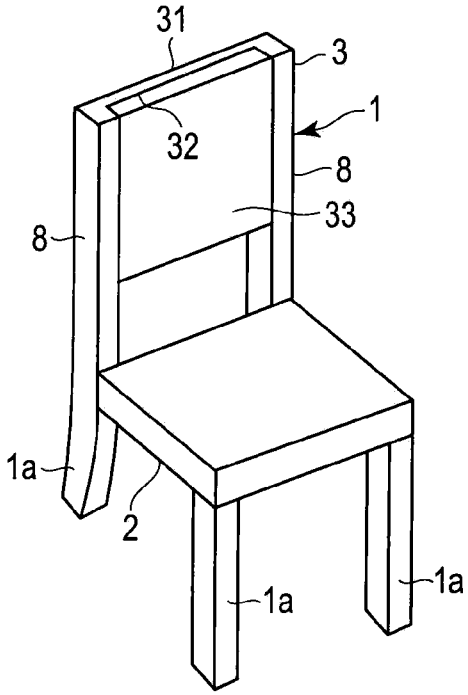
FIG. 14 is a perspective view of a chair according to a seventh embodiment.
Figure 15:
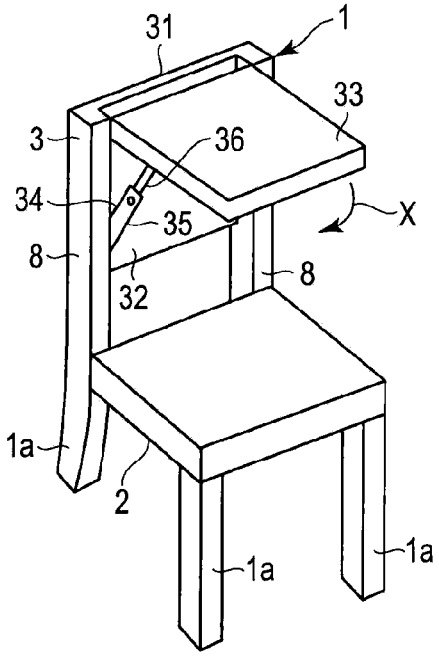
FIG. 15 is a perspective view of a chair shown in FIG. 14, illustrating the backrest held in a first horizontal position.
Figure 16:
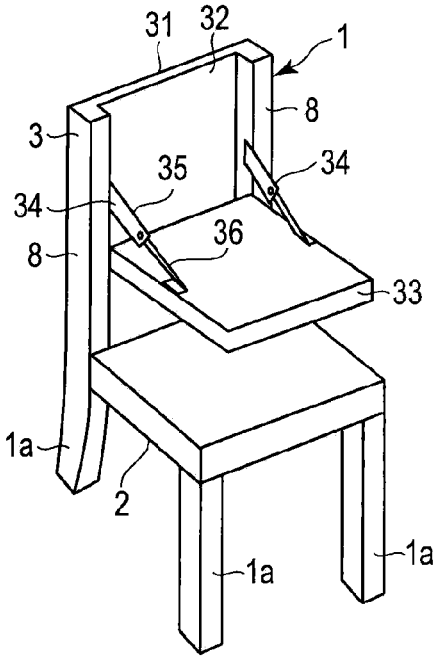
FIG. 16 is a perspective view of a chair shown in FIG. 14, illustrating the backrest held in a second horizontal position.
Figure 17:
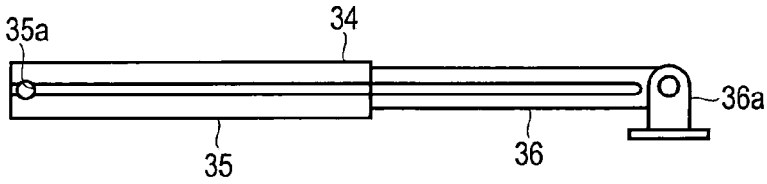
FIG. 17 is a schematic diagram showing a stay coupling the backrest to the seat body of the chair shown in FIG. 14.

A chair 1 according to a seventh embodiment will be described, with reference to FIG. 14 to FIG. 17. FIG. 14 is a perspective view, showing the backrest 33 of the chair 1, which is stored in the back 3 of the chair 1. FIG. 15 is a perspective view of the chair 1, showing the backrest 33 pulled out in a first state. FIG. 16 is a perspective view of the chair 1, showing the backrest 33 pulled out in a second state. FIG. 17 is a schematic diagram showing stays 34 attaching the backrest 33 to the back 3.

The chair 1 according to this embodiment has a back 3, which comprises a pair of stiles 8. The chair 1 further has a back plate 31 extending between the stiles 8. The back plate 31 is provided on the back of the back 3. The back plate 31 has a channel 32 having a rectangular cross section and configured to store the backrest 33. The backrest 33 is coupled by a pair of stays 34 to both stiles 8, and can be rotated. As the stays 34 are expanded and contracted, the backrest 33 can assume various positions shown in FIG. 14 to FIG. 16.

As shown in FIG. 17, either stay 34 has a main arm 35 and a movable arm 36. The movable arm 36 can project and recede in its lengthwise direction, from and into the main arm 35. The movable arm 36 is released from the locked state if pulled from the position where it projects from the main arm 35 to a maximum.

The proximal end of the main arm 35 has a hole **35*a* holding a slider (not shown), enabling the same to rotate. The slider connects the proximal end of the main arm 35 to the associated stile 8. The main arm 35 can therefore slide with respect to the stile 8. More specifically, two slide grooves (not shown) are cut, respectively in the mutually opposing inner sides of the stiles 8, and extend in vertical direction. The slider held in the hole 35*a* of either main arm 35 is engaged in the slide groove cut in the stile 8, whereby the proximal end of the main arm 35 is coupled to the stile 8 associated with the main arm 35**. The sliders can be locked at a prescribed position by means of a lock mechanism (not shown).

Two coupling member **36*a* are secured to the back of the backrest 33, at a part thereof that is middle with respect to height. Either coupling member 36*a* holds the distal end of the movable arm 36 of the associated stay 34, enabling the stay 34 to rotate. If the movable arm of either stay 34 is inserted into the main arm 35, the backrest 33 will be stored into the channel 32 of the back 3 as shown in FIG. 14**.

Assume that the backrest 33 is held at lower edge with hand and then pulled up as shown in FIG. 15. Then, the movable arm 36 slides, projecting from the main arm 35, and the proximal end of the main arm 35 is locked at the prescribed position. Thus, the sliding position the movable arm 36 has with respect to the main arm 35 is locked. In this state (first state), the backrest 33 is held almost horizontal, or almost parallel to the floor. Using the backrest 33 so held, the chair 1 can be held to the top plate 19 of the table 18.

To move the backrest 33 from the first position shown in FIG. 15 to the second position shown in FIG. 16, the stays 34 are rotated downward, each around the proximal end of the main arm 35, and at the same time the backrest 33 is rotated, upside down (by 180°), in the direction of arrow X as shown in FIG. 15. The backrest 33 is thereby takes an almost horizontal position (i.e., second state), abutting on the back plate 31, at its edge facing the edge which abutted the back plate 31 while the backrest 33 remained in the first state.

In the second state, the main arm 35 is locked at a prescribed position, the movable arm 36 is locked at the sliding position it has with respect to the main arm 35, and the backrest 33 is held at a prescribed position. Even in this state, the backrest 33 can be engaged with the top plate 19 of the table 18, thereby holding the chair 1 to the table 18. The chair 1 can be held to the table 18 at a higher position than in the first state.

As specified above, the chair 1 can be held at a higher position than in the case where the backrest 33 assumes the first state, only if the backrest 33 remains in the second state, engaging with the top plate 19 of the table 18. Assume that the height at which to hold the chair 1 to the top plate 19 of the table 18 must be changed in accordance with the type of tools for sweeping the floor or in accordance with the length of the legs 1*a* of the chair 1, i.e., height of the seat 2. Then, it suffices to set the backrest 33 to the first state shown in FIG. 15 or the second state shown in FIG. 16.

How the backrest 33 is changed from the first state to the second state has been explained as an exemplary case. If the backrest 33 is rotated down with hand, at its upper edge, from the normal-use state shown in FIG. 14, it can be immediately changed to the second state, not assuming the first state.

The stays 34 may be so designed that the movable arm 36 projects for a maximum distance while the backrest 33 remains in the first or second state. In this case, the movable arm 36 can be unlocked, only if it is rotated up a little from the first state or only if the backrest 33 is rotated down a little.

Eighth Embodiment

Figure 18:
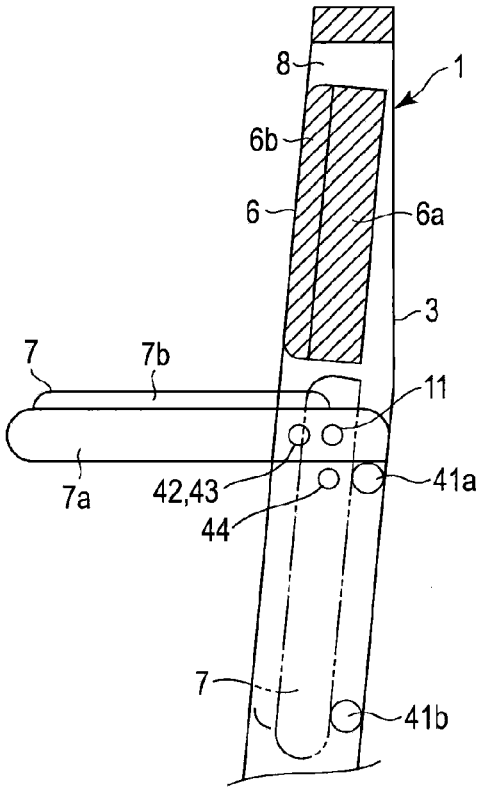
FIG. 18 is a magnified, partially sectional view showing the major section of a chair according to an eighth embodiment.

FIG. 18 is a magnified, partially sectional view showing the back 3 of a chair 1 according to an eighth embodiment. This chair 1 has four pins 41 that support the lower backrest 7 at the back while the lower backrest 7 remains stored in the back 3 (while the assumes the state indicated by a two-dot, dashed line). The four pins 41 perform the same function as the support members 16*a* and 16*b* do in the first embodiment. Of the four pins 41, two protrude from one inner side of one stile 8, and the remaining two protrude from the inner side of the other stile 8. At the inner side of either stile 8, the two pins 41 are spaced apart in the vertical direction.

The two upper pins 41*a* contact the lower backrest 7 at the part lying at the back of the support rods 11, while the lower backrest 7 assumes the position indicated by the solid line in FIG. 18. Thus, the upper pins 41*a* prevent the lower backrest 7 from further rotating upwards. That is, the upper pins 41*a* protrude from the stiles 8, respectively, and so positioned to contact the back of the lower backrest 7 while the lower backrest 7 remains stored in the back 3 and to contact the upper edge of the lower backrest 7, at the back thereof, while the lower backrest 7 remains in an almost horizontal position. In view of this, the lower pins 41*b* are not absolutely necessary, and can be dispensed with, also in the present embodiment.

Two latch claws 42 shaped like a semi-sphere are provided in the sides of the lower backrest 7, respectively. Either latch claw 41 is biased outwards by, for example, a spring (not shown). As shown in FIG. 18, either latch claw 42 is located on the left of the support rod 11, and can be fitted into a semispherical latch hole 43 made in the inner side of the associated stile 8. In other words, the latch claws 42 and the latch holes 43 are so positioned that either latch claw 42 may be fitted in the associated latch hole 43 when the lower backrest 7 is rotated to the almost horizontal position indicated by the solid line in FIG. 18. The lower backrest 7 can therefore be held in a horizontal position and can be supported on the top plate 19 of the table 18, whereby the chair 1 is held to the table 18.

In this embodiment, the latch claws 42 are secured directly to the sides of the lower backrest 7, respectively. Instead, the latch claws 42 may be secured to guide members (not shown) of the type used in the first embodiment.

Further, another latch hole 44 may be made in the inner side of either stile 8, at a position near and below the support hole 14 that receives the support rod 11, enabling the same to rotate. So positioned, the latch hole 44 receives the latch claw 42 of the lower backrest 7 when the lower backrest 7 is stored into the back 3. This prevents the lower backrest 7 from unnecessarily rotating wile stored in the back 3.

In this embodiment, the lower backrest 7 has one latch claw 42 on either side, and either stile 8 has two latch holes 43 and 44 in the inner side. Alternatively, the lower backrest 7 may have one latch hole, and either stile 8 may have two latch claws.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A chair for use in combination with a table, comprising:
a seat;
a back;
legs; and
a backrest able to project forwards from the back and configured to engage with a top plate of the table, thereby to support the chair with the legs suspended above a floor, the backrest being provided at the back and able to rotate around its upper edge, between a position where the backrest is stored in the back and a position where a lower edge of the backrest protrudes forwards from the back;
wherein a support rod and a pin are provided on either lateral side of the backrest, the support rod supporting the backrest, at the upper edge of the backrest, to the back and enabling the backrest to rotate with respect to the back, and the pin located near the support rod; and a guide member is provided at either side of the back and configured to engage with the pin, thereby to control a rotation angle of the backrest.

2. The chair according to claim 1, wherein the guide member has an arcing hole configured to guide the pin, thereby to move the backrest between the position where the backrest is stored in the back and a position where the backrest extends almost horizontally.

3. The chair according to claim 2, further comprising holding means configured to hold the backrest in the position where the backrest extends almost horizontally, after the backrest has been rotated to the position.

4. A chair for use in combination with a table, comprising:
a seat;
a back;
legs; and
a backrest able to project forwards from the back and configured to engage with a top plate of the table, thereby to support the chair with the legs suspended above a floor, the backrest being provided at the back and able to rotate around its upper edge, between a position where the backrest is stored in the back and a position where a lower edge of the backrest protrudes forwards from the back;
wherein a support rod and a pin are provided on either lateral side of the back, the support rod supporting the backrest, at the upper edge of the backrest, to the back and enabling the backrest to rotate with respect to the back, and the pin located near the support rod; and a guide member is provided at either side of the backrest and configured to engage with the pin, thereby to control a rotation angle of the backrest.

5. The chair according to claim 4, wherein the guide member has an arcing hole configured to guide the pin, thereby to move the backrest between the position where the backrest is stored in the back and a position where the backrest extends almost horizontally.

6. The chair according to claim 5, further comprising holding means for holding the backrest in the position where the backrest extends almost horizontally, after the backrest has been rotated to the position.

7. A chair for use in combination with a table, comprising:

a seat;

a back;

legs; and a backrest able to project forwards from the back and configured to engage with a top plate of the table, thereby to support the chair with the legs suspended above a floor, the backrest being provided at the back and able to rotate around its upper edge, between a position where the backrest is stored in the back and a position where a lower edge of the backrest protrudes forwards from the back;

wherein a pin is provided in one of lateral sides of the backrest and the back, a guide member is provided in the other one of the lateral sides of the backrest and the back, and a support rod is provided in one of the lateral sides of the backrest and the back, the support rod supporting the backrest, at the upper edge of the backrest, to the back and enabling the backrest to rotate with respect to the back, and the guide member being configured to engage with the pin, thereby to control a rotation angle of the backrest.

8. The chair according to claim 7, wherein the guide member has an arcing hole configured to guide the pin, thereby to move the backrest between the position where the backrest is stored in the back and a position where the backrest extends almost horizontally.

9. The chair according to claim 8, further comprising holding means for holding the backrest in the position where the backrest extends almost horizontally, after the backrest has been rotated to the position.

* * * * *